US007013698B2

(12) United States Patent
Arduino

(10) Patent No.: US 7,013,698 B2
(45) Date of Patent: Mar. 21, 2006

(54) BENDING PRESS WITH A SUBSTANTIALLY UNDEFORMABLE TOOLHOLDER BEAM

(76) Inventor: Alberto Arduino, Via De Sonnaz, 12, Imperia (IT) 18100

( * ) Notice: Subject to any disclaimer, the term of this patent is extended or adjusted under 35 U.S.C. 154(b) by 168 days.

(21) Appl. No.: 10/686,267

(22) Filed: Oct. 16, 2003

(65) Prior Publication Data

US 2004/0099038 A1 May 27, 2004

(30) Foreign Application Priority Data

Oct. 17, 2002 (IT) ..... TO2002A0904

(51) Int. Cl.
*B21D 5/02* (2006.01)

(52) U.S. Cl. ..... 72/389.5; 72/389.4; 72/413

(58) Field of Classification Search ..... 72/413, 72/389.5, 389.4
See application file for complete search history.

(56) References Cited

U.S. PATENT DOCUMENTS 3,682,465 A * 8/1972 Hanni ..... 72/389.5
3,702,558 A * 11/1972 Swenson et al. ..... 72/389.5
3,914,975 A * 10/1975 Kawano ..... 72/389.5
4,014,204 A * 3/1977 Hanni et al. ..... 72/413
4,098,109 A 7/1978 Cailloux et al.
4,426,873 A 1/1984 Pearson et al.
5,293,972 A * 3/1994 Krumholz ..... 72/389.5

FOREIGN PATENT DOCUMENTS

JP 10 058043 A 3/1998

* cited by examiner

*Primary Examiner*—David Jones
(74) *Attorney, Agent, or Firm*—Sughrue Mion, PLLC

(57) ABSTRACT

Bending press comprising: a stationary support structure (11), a first and a second toolholder unit (12, 13) movable relative to each other between an open position and a closed position, actuator means (14) able to command the relative motion between the toolholder units (12, 13) and to apply a bending force between the stationary structure (11) and at least one of said toolholder units (12, 13). At least one of said toolholder units (12, 13) comprises: a reaction structure (15), a precision structure (17) destined to bear a bending tool, and elastic means (198) positioned between the precision structure (17) and the reaction structure (15) and able to allow a movement of the precision structure (17) relative to the reaction structure (15) under the action of the bending load.

13 Claims, 4 Drawing Sheets

BENDING PRESS WITH A SUBSTANTIALLY UNDEFORMABLE TOOLHOLDER BEAM

Figure 1:
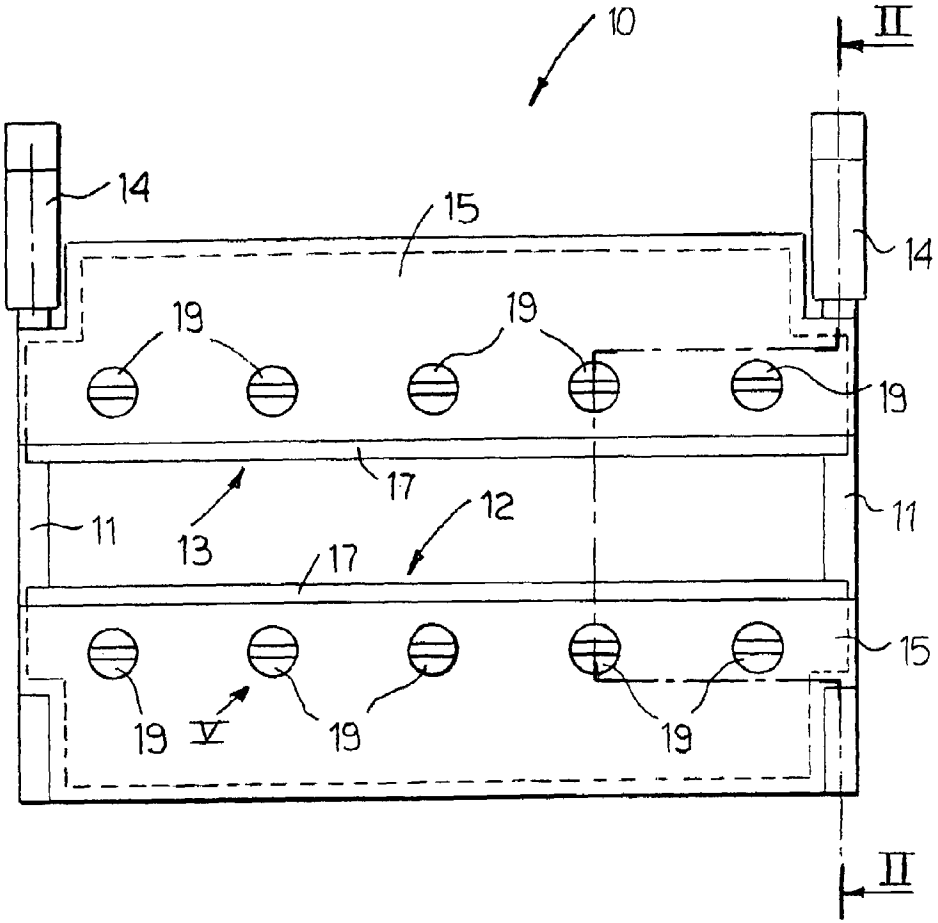

The present invention relates to a bending press according to the preamble of the main claim.

A known bending press is usually formed by a stationary support structure, two toolholder units, movable relative to one another between an open position and a closed position, and actuator means able to command the relative motion of said toolholder units and to apply a bending force between the stationary support structure and at least one of said toolholder units.

During bending operations, the toolholder units of a same bending press are subject to flexion deformations under the action of the bending load. The amplitude of such deformations depends on the bending load and on the geometry of the press, in particular on the rigidity and on the type of connection constraints between the toolholder units and the stationary support structure. Deformations of the toolholder tools are the main cause of imprecision in the bending operation. Manufacturers of bending presses have devoted particular attention to the development of systems that allow to control the deformation of the toolholder units under load. The purpose of these systems is to minimise the differences between the deformed profiles of the two toolholder units. Known devices for reducing bending inaccuracies due to the deformations under load of the toolholder units can be classified according to two categories:

1) active devices: these devices entail the use of actuators, also numerically controlled, which produce variations in the deformed profile of one or both the beams bearing the bending tools.

2) passive devices: the geometry of the toolholder units is designed in such a way as to obtain similar deformations in terms of shape and amplitude on both toolholder beams.

In particular in the field of passive devices, toolholder tables have been proposed, provided with constraining systems which allow to optimise the deformed profiles of the beam. In particular, bending presses are already known in which the lower toolholder unit comprises two parallel support beams fastened to the stationary support structure of the press and a toolholder beam centrally positioned between the two support beams and connected to said support beams by means of rigid pivots or by means of welds, arranged in such a way that under the action of the bending load the lower toolholder beam tends to be deformed in a manner corresponding to the upper toolholder beam.

The present invention has the aim of providing a bending press that allows to reduce to negligible values the flexion deformations of one or of both toolholder beams.

According to the present invention, said aim is achieved by a bending press having the characteristics set out in the main claim.

The present invention provides for the realisation of at least one of the toolholder units of a bending press in the form of an assembly comprising:

- a precision structure which remains substantially undeformed under the action of the bending force,
- a reaction structure which transfers the bending force from the precision structure to the stationary support structure of the bending press and which is substantially free to deform elastically under the action of the load received from the precision structure, and
- elastic means whose task is to transfer the forces from the precision structure to the reaction structure.

A toolholder unit according to the present invention allows to reduce to wholly negligible values the deformations of the precision structure that is destined to bear the bending tool. Such deformations can easily be contained within the tolerance required by the bending work process. Flexion deformations are concentrated on the reaction structure, whose task is to sustain the precision structure through the elastic means and to transfer the bending load to the support structure of the press.

As shall become more readily apparent in the remainder of the description, the deformations of the reaction structure have no influence on the precision of the bending operation.

The present invention therefore allows to obtain very high bending precision with a relatively light dimensioning of the toolholder units.

Figure 2:
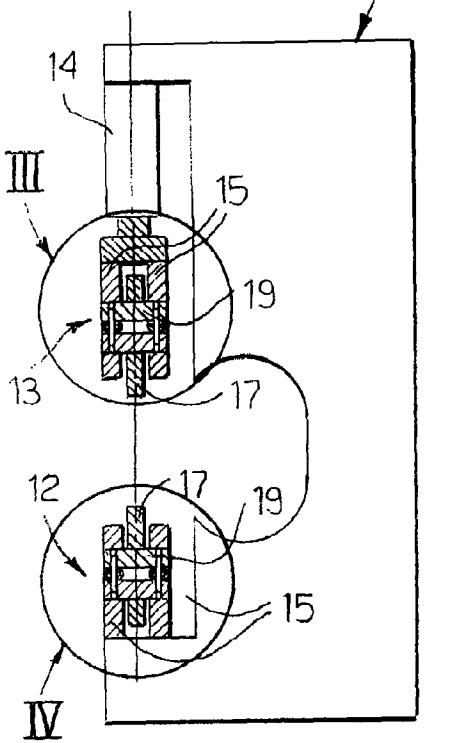
Figure 4:
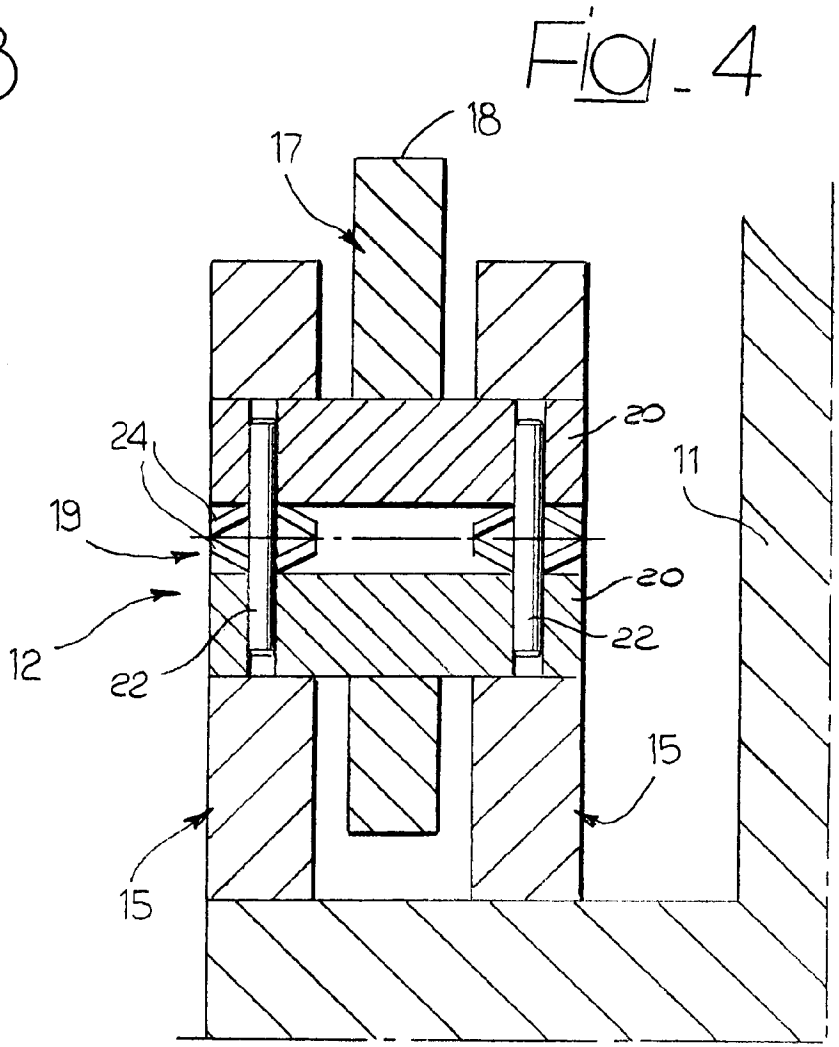
Figure 3:
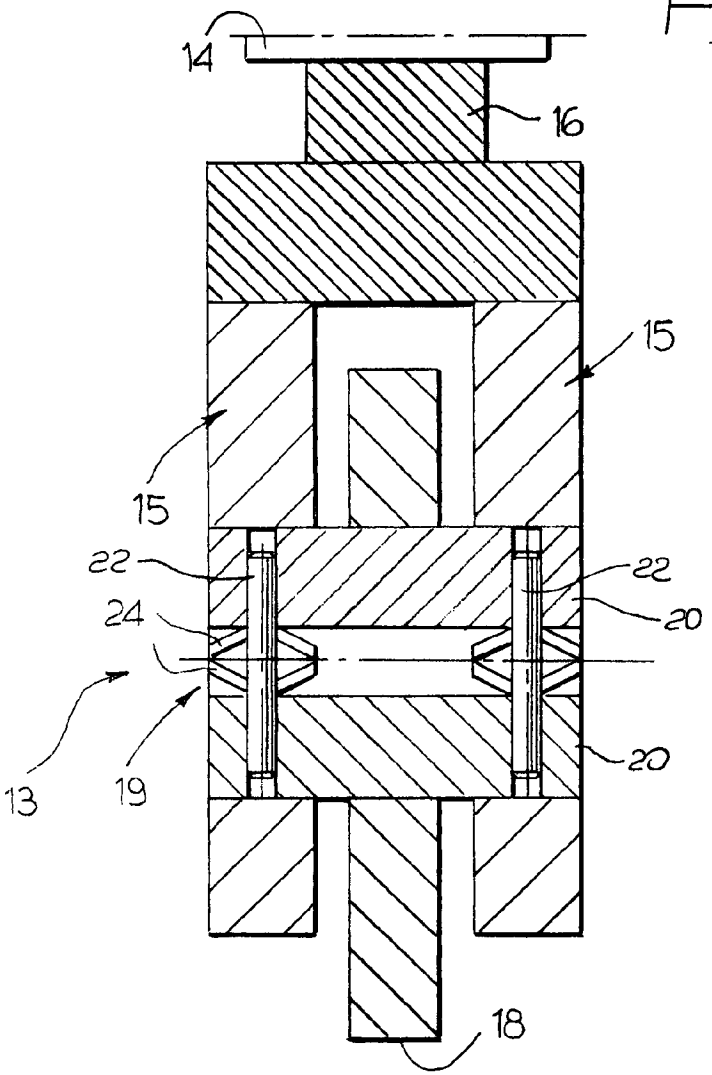
Figure 5:
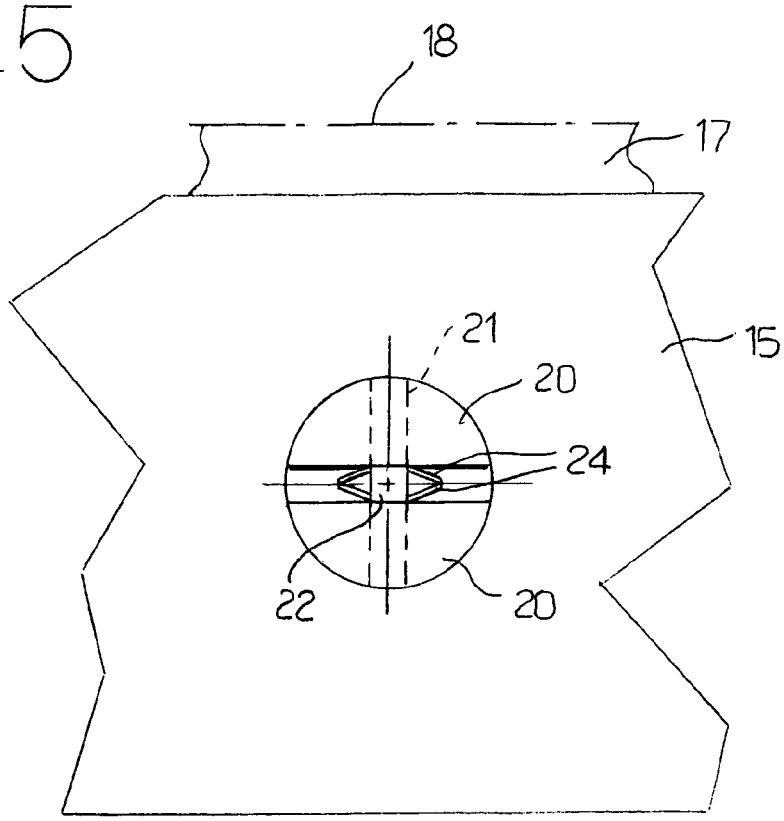
Figure 7:
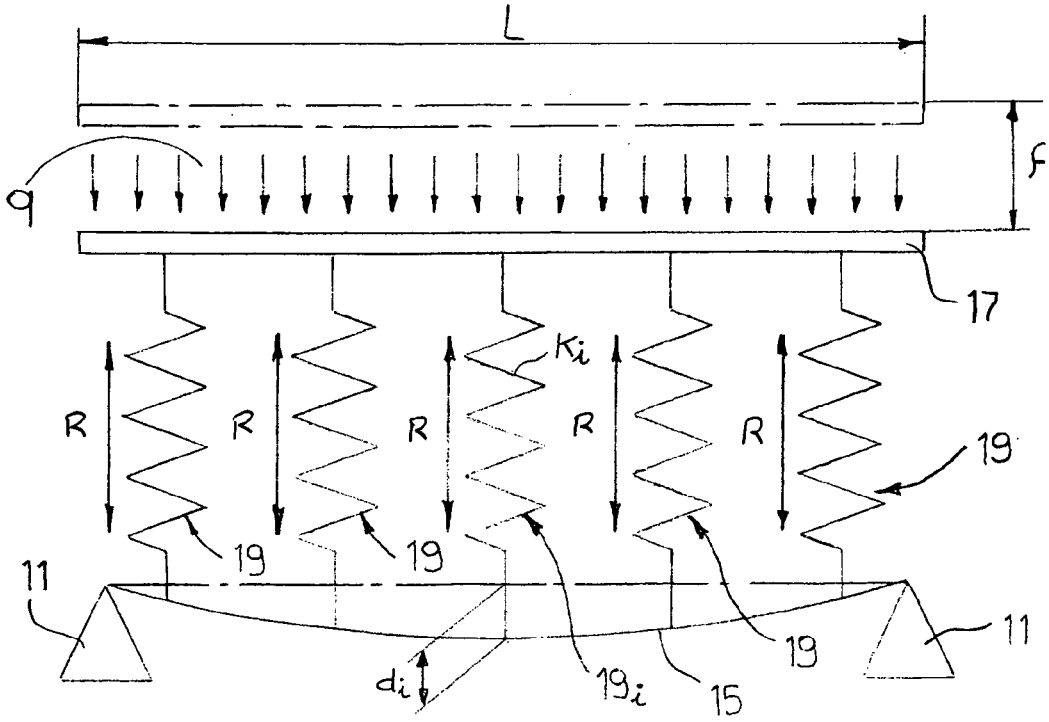
Figure 6:
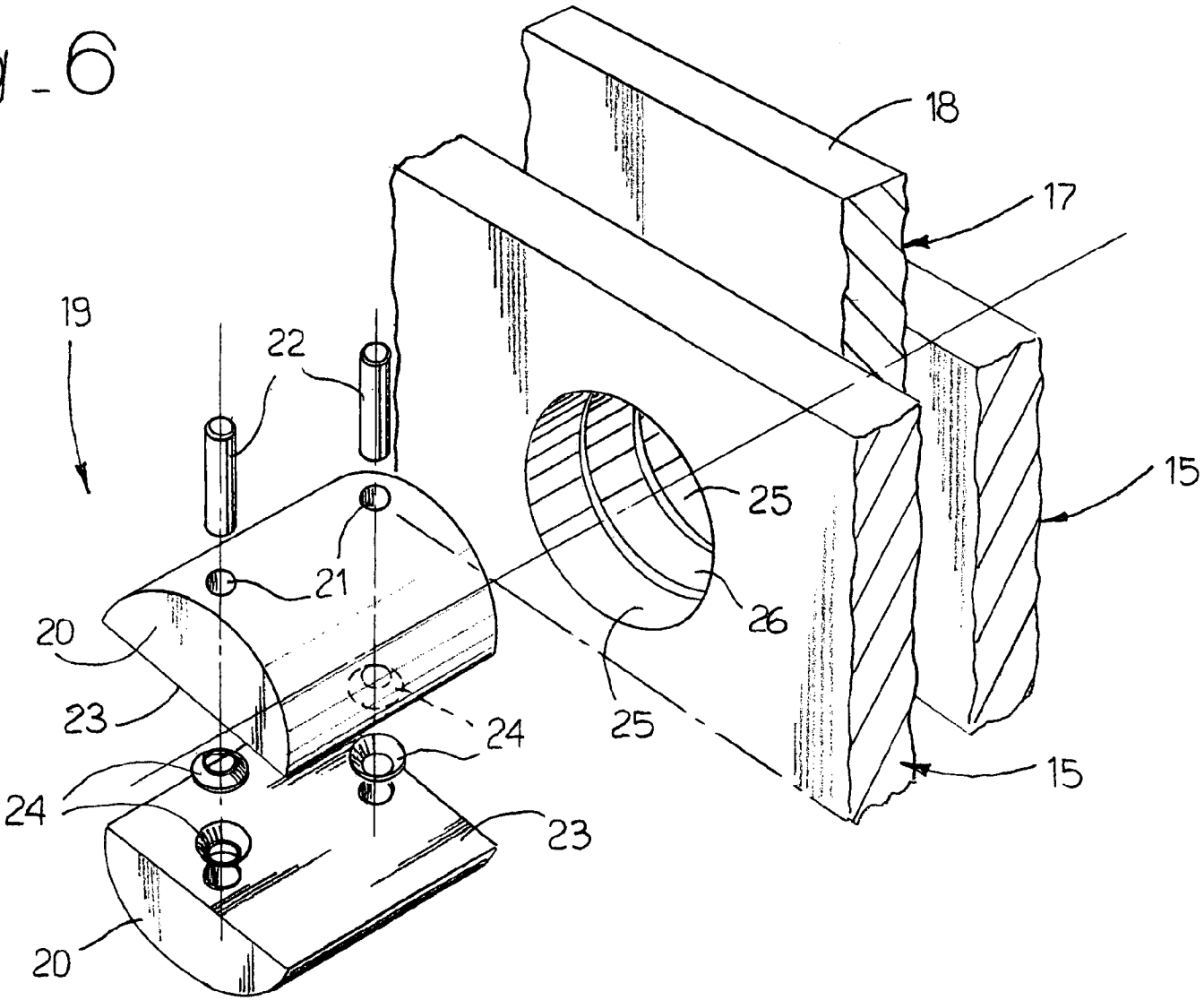

An embodiment of the present invention shall now be described in detail with reference to the accompanying drawings, provided purely by way of non limiting example, in which:

FIG. 1 is a schematic front view of a bending press according to the present invention, FIG. 2 is a schematic section according to the line II—II of FIG. 1, FIGS. 3 and 4 are sections illustrating in enlarged scale the parts indicated by the arrows III and IV in FIG. 2, FIG. 5 is a front view in enlarged scale showing the detail indicated by the arrow V in FIG. 1, FIG. 6 is a schematic perspective view of an elastic connection device used in the press according to the present invention, and FIG. 7 is a schematic view illustrating the operating principle of a toolholder unit according to the present invention.

DETAILED DESCRIPTION OF THE INVENTION

With reference to FIGS. 1 and 2, the reference number 10 designates a bending press comprising a stationary support structure formed by two or more strong uprights 11, substantially "C" shaped. The bending press 10 comprises a lower toolholder unit 12 fastened to the uprights 11 and an upper toolholder unit 13 movable in the vertical direction relative to the lower toolholder unit 12 between a raised position and a lowered position. The press 10 comprises two or more actuators 14 interposed between the uprights 11 and the upper toolholder unit 13.

According to the present invention, at least one of the two toolholder units 12, 13 comprises a precision structure whereon is destined to be mounted a bending tool, said structure being connected by elastic means to a reaction structure. From the conceptual point of view, the precision structure is supported in floating fashion by the reaction structure and it is free to move relative to the reaction structure under the action of the bending load. Between the precision structure and the reaction structure there is no bond except the one constituted by the elastic means whose task is to allow the relative motion between the precision structure and the reaction structure and to transfer the bending force from the precision structure to the reaction structure.

A concrete embodiment of the present invention is schematically shown in FIGS. 3 and 4. The figures show the case in which both toolholder units 12, 13 comprise a precision structure and a reaction structure, with elastic means interposed between said structure, but it is also possible to construct a bending press in which only one of the toolholder units 12 or 13 is built in this manner.

With reference to FIGS. 3 and 4, each toolholder unit 12, 13 comprises a reaction structure including two beams 15, parallel and distanced from each other. In the case of the lower toolholder unit 12, the beams 15 forming the reaction structure are fastened to the stationary support structure. Said fastening can be achieved by welding, restrained joint or by means of screws. In the case of the upper toolholder 13, the beams 15 forming the reaction structure are fastened to the movable parts 16 of the actuators 14. Each toolholder unit 12, 13 comprises a precision structure constituted by a beam 17 positioned between the beams 15. Each of the beams 15 and 17 is constituted by a strong metallic plate, generally having flattened parallelepiped shape. The beam 17 is arranged substantially in sandwiched fashion between the beams 15.

In a variation of the present invention, the precision structure could be constituted by the outer beams 15 and the reaction structure by the central beam 17.

The central beam 17 constituting the precision structure is provided with conventional means (not shown) which allow to fasten a bending tool to the outer edge 18 of the beam 17. Generally, the beam 17 of the upper toolholder unit 13 is destined to bear a punch whilst the beam 17 of the lower toolholder unit 12 is destined to bear a die.

The beam 17 of each toolholder unit 12, 13 is connected to the two lateral beams 15 solely by elastic means having a set stability in order to allow a relative motion of predetermined amplitude of the central beam 17 with respect to the lateral beams 15 under the action of the nominal bending load of the press.

In the practical embodiment shown by way of example in the figures, the elastic means connecting the precision structure 17 to the reaction structure 15 comprise a plurality of elastic devices 19 each of which is preferably constructed as shown in FIGS. 3 through 6. Each elastic device 19 comprises two bodies 20 of semi-cylindrical shape made of metallic material, provided with through holes 21 through which extend respective pivot pins 22. The bodies 20 are free to move relative to the pivot pins 22. Between the two planar, mutually facing surfaces 23 of the semi-cylindrical bodies are positioned elastic elements 24 arranged coaxially to the pivot pins 22. The elastic elements 24 are preferably constituted by Belleville washers.

The beams 15 and 17 are provided with aligned holes 25, 26 within which is inserted a respective elastic device 19. As shown in FIGS. 3 and 4, each elastic device 19 has end portions that engage the holes 25 of the lateral beams 15 and a central portion that engages the hole 26 of the central beam 17.

As shown in FIG. 1, each toolholder unit 12, 13 is provided with a plurality of elastic devices 19 distributed along its length. The number and the disposition of the elastic devices 19 may vary to suit applications. In particular, the elastic devices 19 may be positioned with constant or variable relative distance.

With reference to FIGS. 3 and 4, when the central beam 17 is subjected to a load in the vertical direction, the elastic devices 19 are compressed and they transfer an elastic load of equal intensity to the lateral beams 15. The pivot pins 22 of each elastic device 19 guide the relative approach motion between the two semi-cylindrical bodies 20.

FIG. 7 schematically shows a toolholder unit according to the present invention subjected to a bending force q equally distributed along the length L of the beam 17 constituting the precision structure. The beams 15 constituting the reaction structure are schematically represented as a beam resting at the ends. Each of the elastic devices 19 in the representation of FIG. 8 is represented by a compressed spring subjected to a force R. Under the action of the load q, the beam 17 moves by a quantity f from the rest condition. The rigidity of a generic elastic device $\mathbf{19}_i$ is designated by the reference $K_i$. The elastic deformation of the beams 15 in correspondence with the generic elastic device $\mathbf{19}_i$ is designated by the reference $d_i$.

The rigidities $k_i$ of the elastic devices 19 differ from each other and are determined in such a way that the elastic reactions R of the individual elastic devices 19 are mutually identical. Therefore, if n is the number of elastic devices 19 and q is the force per unit of length (or unit load) acting on the beam 17, one will have:

$$n \times R = q \times L.$$

Each of the elastic devices 19 is compressed by a quantity equal to $f-d_i$. Therefore, the elastic reaction R of each elastic device 19 will be $R=K_i \times (f-d_i)$.

The rigidity $K_i$ of each elastic device 19 is computed as follows:

1) the number n of the elastic devices 19 is chosen and, as a function of the nominal bending load q, the value of each elastic reaction R is computed from the relationship:

$$R = \frac{q \times L}{n}$$

2) the reaction structure 15 behaves like a beam resting at the ends and subjected to n forces, all with intensity R. Depending on the shape and dimensions of the reaction structure 15, a calculation is used to determine individual deformations $d_i$ in correspondence with each point of application of the force R;

3) a displacement f is imposed on the precision beam 17 such that f is greater than the maximum deformation $d_i$; the value f must also be lesser than the distance at rest (in the absence of a load) between the semi-cylindrical bodies 20 of each elastic device 19;

4) the rigidity of each elastic element 19 is determined from the relationship:

$$K_i = \frac{R}{(f - d_i)}$$

From the structural viewpoint, the precision beam 17 behaves like a beam whereon on one side acts a uniformly distributed load q and on the other act n mutually equal forces, all with intensity R. The beam is in equilibrium conditions when the relationship $n \times R = q \times L$ is true. The precision structure 17 is substantially undeformed with the exception of the small elastic deformations between the points of application of the forces R due to the distributed load q. This deformation can easily be contained within the tolerance limits allowed for bending work processes. The elastic deformations of the reaction structure 15 do not influence bending precision in any way. Therefore, the beams 15 constituting the reaction structure may be dimensioned in relatively light fashion since these beams can be deformed elastically even by significant amounts under the action of the elastic reaction forces $n \times R$.

The different rigidity of the elastic devices 19 can be obtained by varying the number or the dimensions of the Belleville washers 24 with which is device 19 is provided.

Naturally, the present invention may be subjected to numerous variations with respect to what is described and illustrated herein, without thereby departing from the scope of the invention. For example, for technological or constructive reasons it could be necessary to position the elastic devices 19 at non constant relative distances. In this case, there will be deformation differences on the individual segments of the precision beam, but the condition that the fastening points all move by the same quantity f is still met by appropriately re-dimensioning the rigidities $K_i$. With unequal distances between the devices 19, the elastic reactions $R_i$ are different in the different fastening points, the calculation process shall develop as follows:

1) the number of fastening points is decided along with the distance between them, and the value of each reaction $R_i$ is calculated;

2) the reactions $R_i$ are applied on the reaction beam and the displacements $d_i$ are calculated in correspondence with each point of application of the forces $R_i$, 3) a constant displacement f of the precision beam is imposed, such that f is greater than the greatest deformation $d_i$: $f>d_{max}$ 4) the rigidity of each elastic element is derived from the relationship:

$$K_i = \frac{R_i}{(f - d_i)}$$

It must be noted that if the distance between the elastic devices 19 is not constant, there are variations in the maximum flexion of the prevision beam if the rigidity of the prevision beam is constant along its length. It is possible to obtain equal flexion amounts of the precision beam on the bays of different length by appropriately varying the rigidity of the beam along its longitudinal direction.

What is claimed is:

1. Bending press comprising:

a stationary support structure, a first and a second toolholder unit movable relative to each other between an open position and a closed position, actuator means able to command the relative motion between the toolholder units and to apply a bending force between the stationary structure and at least one of said toolholder units, wherein at least one of said toolholder units comprises:

a reaction structure, a precision structure destined to bear a bending tool, and elastic means positioned between the precision structure and the reaction structure and able to allow a movement of the precision structure relative to the reaction structure under the action of the bending load, and wherein said toolholder unit comprises a pair of lateral beams (15) between which is positioned a central beam.

2. Bending press as claimed in claim 1, wherein the central beam is connected to the lateral beams by said elastic means which comprises a plurality of elastic devices each of which comprises two bodies, movable relative to each other, between which are positioned elastic elements.

3. Bending press as claimed in claim 2, wherein each of said elastic devices comprises two bodies with semi-cylindrical shape with respective mutually facing surfaces, which bodies are mutually connected by guiding pivot pins.

4. Bending press as claimed in claim 3, wherein said elastic elements are positioned coaxially to said guiding pivot pins.

5. Bending press as claimed in claim 4, wherein said elastic elements comprise a plurality of Belleville washers.

6. Bending press as claimed in claim 5, wherein each of said elastic devices has end portions that engage two aligned holes of said lateral beams and a central portion which engages a hole of said central beam.

7. Bending press comprising:

a stationary support structure (11), a first and a second toolholder unit (12, 13) movable relative to each other between an open position and a closed position, actuator means (14) able to command the relative motion between the toolholder units (12, 13) and to apply a bending force between the stationary structure (11) and at least one of said toolholder units (12, 13), wherein at least one of said toolholder units (12, 13) comprises:

a reaction structure (15), a precision structure (17) destined to bear a bending tool, and a plurality of elastic devices (19) distributed along the length of the toolholder unit (12, 13), positioned between the precision structure (17) and the reaction structure (15) and able to allow a movement of the precision structure (17) relative to the reaction structure (15) under the action of the bending load, characterised in that said elastic devices (19) have mutually different rigidities ($K_i$).

8. Bending press as claimed in claim 7, characterised in that said toolholder unit (12, 13) comprises a pair of lateral beams (15) between which is positioned a central beam (17).

9. Bending press as claimed in claim 8, characterised in that the central beam (17) is connected to the lateral beams (15) by means of a plurality of said elastic devices (19), each of which comprises two bodies (20), movable relative to each other, between which are positioned elastic elements (24).

10. Bending press as claimed in claim 9, characterised in that each of said elastic devices (19) comprises two bodies with semi-cylindrical shape with respective mutually facing surfaces (23), which bodies are mutually connected by guiding pivot pins (22).

11. Bending press as claimed in claim 10, characterised in that said elastic elements (24) are positioned coaxially to said guiding pivot pins (22).

12. Bending press as claimed in claim 11, characterised in that said elastic elements comprise a plurality of Belleville washers (24).

13. Bending press as claimed in claim 12, characterised in that each of said elastic devices (19) has end portions that engage two aligned holes (25) of said lateral beams (15) and a central portion which engages a hole (26) of said central beam (17).

* * * * *